US007353672B2

(12) United States Patent
Lu

(10) Patent No.: US 7,353,672 B2
(45) Date of Patent: Apr. 8, 2008

(54) LOCK ASSEMBLY

(75) Inventor: Francisco Lu, Kansan (TW)

(73) Assignee: MIZ Engineering Ltd. (TW)

( * ) Notice: Subject to any disclaimer, the term of this patent is extended or adjusted under 35 U.S.C. 154(b) by 0 days.

(21) Appl. No.: 11/790,995

(22) Filed: Apr. 30, 2007

(65) Prior Publication Data

US 2008/0053168 A1 Mar. 6, 2008

Related U.S. Application Data

(62) Division of application No. 11/515,003, filed on Sep. 5, 2006, now Pat. No. 7,234,326.

(30) Foreign Application Priority Data

Jan. 24, 2007 (TW) ..... 96102666 A

(51) Int. Cl.
*E05B 69/00* (2006.01)

(52) U.S. Cl. ..... 70/58; 70/14; 70/57; 70/428

(58) Field of Classification Search ..... 70/14, 70/18, 30, 49, 57, 58, 423–428; 248/551–553
See application file for complete search history.

(56) References Cited

U.S. PATENT DOCUMENTS 5,327,752 A * 7/1994 Myers et al. ..... 70/58
5,875,657 A * 3/1999 Kelley ..... 70/18
6,058,744 A * 5/2000 Ling ..... 70/28
6,112,562 A * 9/2000 Murray et al. ..... 70/58
6,199,413 B1 * 3/2001 McDaid et al. ..... 70/58
6,205,824 B1 * 3/2001 Miao ..... 70/58
6,401,502 B1 * 6/2002 Yang ..... 70/30
6,536,244 B1 * 3/2003 Chang ..... 70/58
6,918,272 B1 * 7/2005 Sanders ..... 70/58
6,968,716 B1 * 11/2005 Ling ..... 70/14
6,973,809 B2 * 12/2005 Chang ..... 70/58
7,302,816 B1 * 12/2007 Lu ..... 70/58
2003/0106349 A1 * 6/2003 Broadbridge et al. ..... 70/58
2004/0065126 A1 * 4/2004 Yang ..... 70/58
2007/0169523 A1 * 7/2007 Lu ..... 70/58

* cited by examiner

*Primary Examiner*—Suzanne Dino Barrett
(74) *Attorney, Agent, or Firm*—Davidson Berquist Jackson & Gowdey LLP

(57) ABSTRACT

A lock assembly includes a plurality of lock devices and a locking chain. Each lock device includes: a lock housing unit including upper and lower lock housings respectively formed with a rod hole and a jaw hole; a jaw actuating unit including a jaw actuator operable to move between locking and unlocking positions, and an urging member for urging the jaw actuator to the locking position, the jaw actuator having a ring portion and an operating rod extending through the rod hole; and a jaw unit including two locking jaws each having a hooking section that extends out of the jaw hole and an opposite force bearing section, and two biasing members for biasing the force bearing sections toward each other. The locking chain is extended removably through the positioning rings and the ring portion of each of the lock devices.

21 Claims, 10 Drawing Sheets

LOCK ASSEMBLY

CROSS-REFERENCE TO RELATED APPLICATION

This application claims priority of Taiwanese application no. 096102666, filed on Jan. 24, 2007.

This application is also a continuation-in-part (CIP) of U.S. patent application Ser. No. 11/515,003, entitled "LOCK DEVICE", filed on Sep. 5, 2006.

BACKGROUND OF THE INVENTION

1. Field of the Invention

The present invention relates to a lock assembly, more particularly to a lock assembly suitable for use when locking a number of hardware devices together.

2. Description of the Related Art

In order to prevent theft of expensive peripheral hardware devices or products, manufacturers usually form such devices with a lock hole for mounting of a lock assembly, which includes a locking chain that can be tied to a fixed object.

However, since the conventional lock assembly is designed for application to only one hardware device, several lock assemblies are required when protecting a corresponding number of the hardware devices from theft. In view of the cost of each lock assembly, which includes a lock body, a locking chain and a key, high expenses are incurred when protecting a large number of the hardware devices from theft. Moreover, it is both troublesome and inconvenient to manage or handle individual keys of a large number of the lock assemblies. In addition, tying the locking chains of a number of the lock assemblies to the same fixed object results in an untidy environment.

SUMMARY OF THE INVENTION

Therefore, the object of the present invention is to provide a lock assembly that is suitable for use when locking a number of objects together to protect the objects from theft.

According to one aspect of the present invention, there is provided a lock assembly that is adapted for use with at least one object having a lock hole. The lock assembly includes a plurality of lock devices and a locking chain.

Each of the lock devices includes a lock housing unit, a jaw actuating unit, and a jaw unit.

The lock housing unit includes an upper lock housing and a lower lock housing. The upper lock housing has a coupling part that is formed with a rod hole, and two positioning rings that extend outwardly from the coupling part, that are spaced apart from and registered with each other, and that are each formed with a first ring hole. The lower lock housing has a first end part coupled to the coupling part of the upper lock housing, and a second end part formed with a jaw hole.

The jaw actuating unit includes a jaw actuator and an urging member. The jaw actuator is operable to move relative to the lock housing unit between locking and unlocking positions. The jaw actuator has a ring portion that is confined between the positioning rings of the upper lock housing, and that is formed with a second ring hole, and an operating rod that extends from the ring portion and through the rod hole in the upper lock housing. The urging member urges the jaw actuator to the locking position.

The jaw unit includes an overlapping pair of locking jaws, and a pair of biasing members. The locking jaws are received in the lower lock housing, and are pivoted to each other and to the lower lock housing. Each of the locking jaws has a hooking section that extends out of the jaw hole in the lower lock housing and that is extendible into the lock hole in one of the objects to engage a periphery of the lock hole, and a force bearing section opposite to the hooking section. The biasing members bias the force bearing sections of the locking jaws toward each other.

The ring portion is aligned with the positioning rings, and the operating rod extends between and forces apart the force bearing sections of the locking jaws when the jaw actuator is at the locking position, thereby forcing the hooking sections of the locking jaws apart from each other such that the hooking sections of the locking jaws are capable of engaging the periphery of the lock hole when extended into the lock hole.

The positioning rings and the ring portion are misaligned, and the operating rod permits movement of the force bearing sections of the locking jaws toward each other by virtue of biasing action of the biasing members when the jaw actuator is at the unlocking position, thereby forcing the hooking sections of the locking jaws toward each other such that the hooking sections of the locking jaws can be extended into and removed from the lock hole and are unable to engage the periphery of the lock hole.

The locking chain has a cross-section slightly smaller than the first and second ring holes, and is extended removably through the first ring holes and the second ring hole of each of the lock devices, thereby arresting movement of the jaw actuators of the lock devices from the locking position to the unlocking position and thereby stringing together the lock devices.

According to another aspect of the present invention, there is provided a lock assembly that is adapted for use with at least one object having a lock hole. The lock assembly includes a plurality of lock devices and a locking chain.

Each of the lock devices includes a lock housing unit, a jaw actuating unit, and a jaw unit.

The lock housing unit includes an upper lock housing and a lower lock housing. The upper lock housing has a coupling part that is formed with a rod hole, and two positioning rings that extend outwardly from the coupling part, that are spaced apart from and registered with each other, and that are each formed with a first ring hole, the upper lock housing including first and second housing bodies coupled to each other. Each of the first and second housing bodies has a lower end part and an upper end part that extends from the lower end part. The lower end parts of the first and second housing bodies cooperate to serve as the coupling part of the upper lock housing, and define the rod hole and a rotation space therebetween and in spatial communication with each other. The upper end parts of the first and second housing bodies are formed with the positioning rings, respectively. The lower lock housing has a first end part coupled to the coupling part of the upper lock housing, and a second end part formed with a jaw hole, the first end part of the lower lock housing being received in the rotation space and being coupled rotatably to the lower end parts of the first and second housing bodies.

The jaw actuating unit includes a jaw actuator and an urging member. The jaw actuator is operable to move relative to the lock housing unit between locking and unlocking positions. The jaw actuator has a ring portion that is confined between the positioning rings of the upper lock housing, and that is formed with a second ring hole, and an operating rod that extends from the ring portion and through the rod hole in the upper lock housing. The urging member urges the jaw actuator to the locking position.

The jaw unit includes an overlapping pair of locking jaws, and a pair of biasing members. The locking jaws are received in the lower lock housing, and are pivoted to each other and to the lower lock housing. Each of the locking jaws has a hooking section that extends out of the jaw hole in the lower lock housing and that is extendible into the lock hole in one of the objects to engage a periphery of the lock hole, and a force bearing section opposite to the hooking section. The biasing members bias the force bearing sections of the locking jaws toward each other.

The ring portion is aligned with the positioning rings, and the operating rod extends between and forces apart the force bearing sections of the locking jaws when the jaw actuator is at the locking position, thereby forcing the hooking sections of the locking jaws apart from each other such that the hooking sections of the locking jaws are capable of engaging the periphery of the lock hole when extended into the lock hole.

The positioning rings and the ring portion are misaligned, and the operating rod permits movement of the force bearing sections of the locking jaws toward each other by virtue of biasing action of the biasing members when the jaw actuator is at the unlocking position, thereby forcing the hooking sections of the locking jaws toward each other such that the hooking sections of the locking jaws can be extended into and removed from the lock hole and are unable to engage the periphery of the lock hole.

The locking chain has a cross-section slightly smaller than the first and second ring holes, and is extended removably through the first ring holes and the second ring hole of each of the lock devices, thereby arresting movement of the jaw actuators of the lock devices from the locking position to the unlocking position and thereby stringing together the lock devices.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
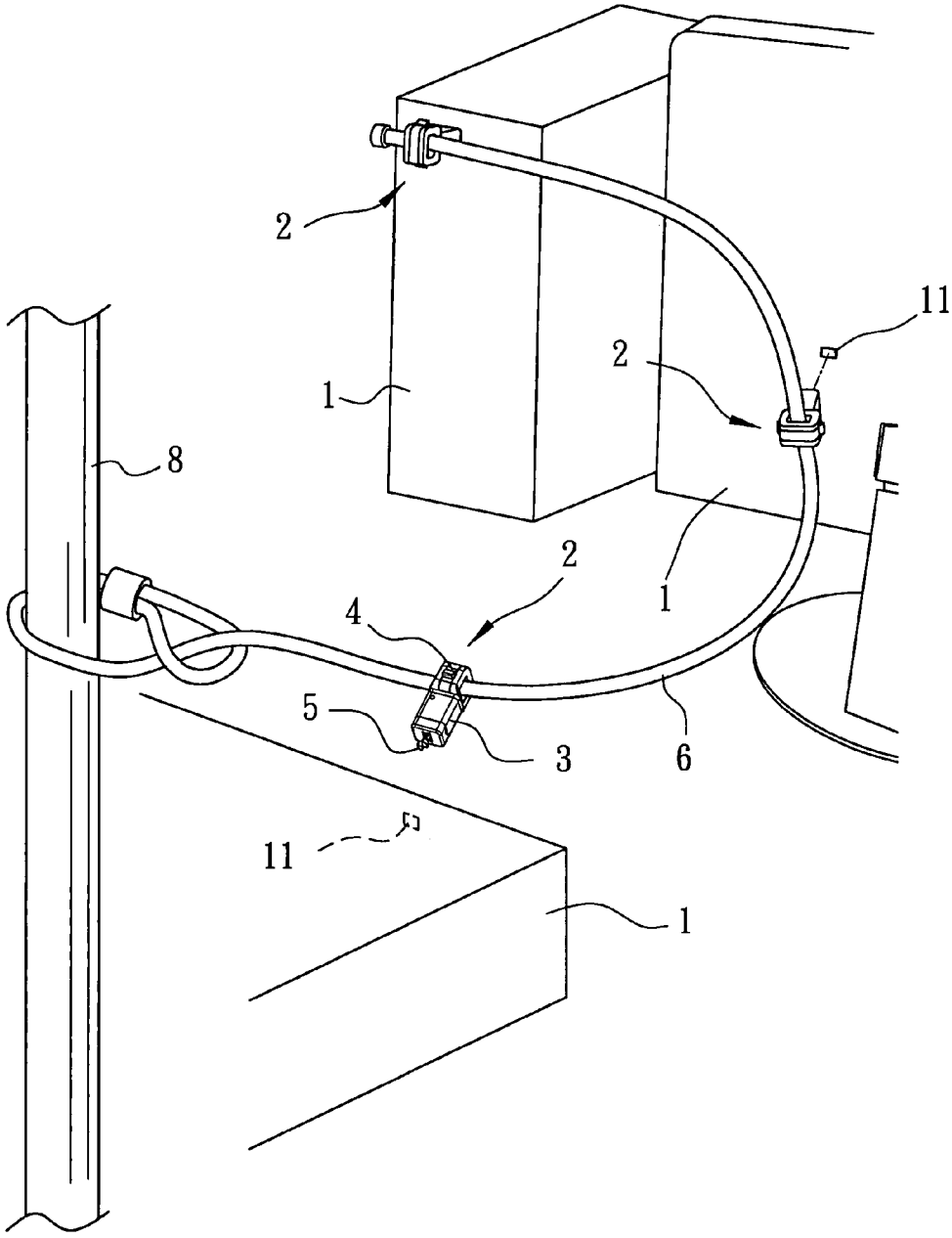
FIG. 1 is a perspective view to illustrate the first preferred embodiment of a lock assembly according to the present invention in a state of use, where a plurality of lock devices are strung together by a locking chain.

As shown in FIG. 1, the first preferred embodiment of a lock assembly according to the present invention is shown to be adapted for use with at least one object 1 having a lock hole 11. The object 1 can be an electronic device, such as a liquid crystal display, a desktop computer, a notebook computer, a printer, a projector, a digital camera, a video camcorder, etc.

The lock assembly includes a plurality of lock devices 2 and a locking chain 6. Each of the lock devices 2 includes a lock housing unit 3, a jaw actuating unit 4, and a jaw unit 5.

Figure 2:
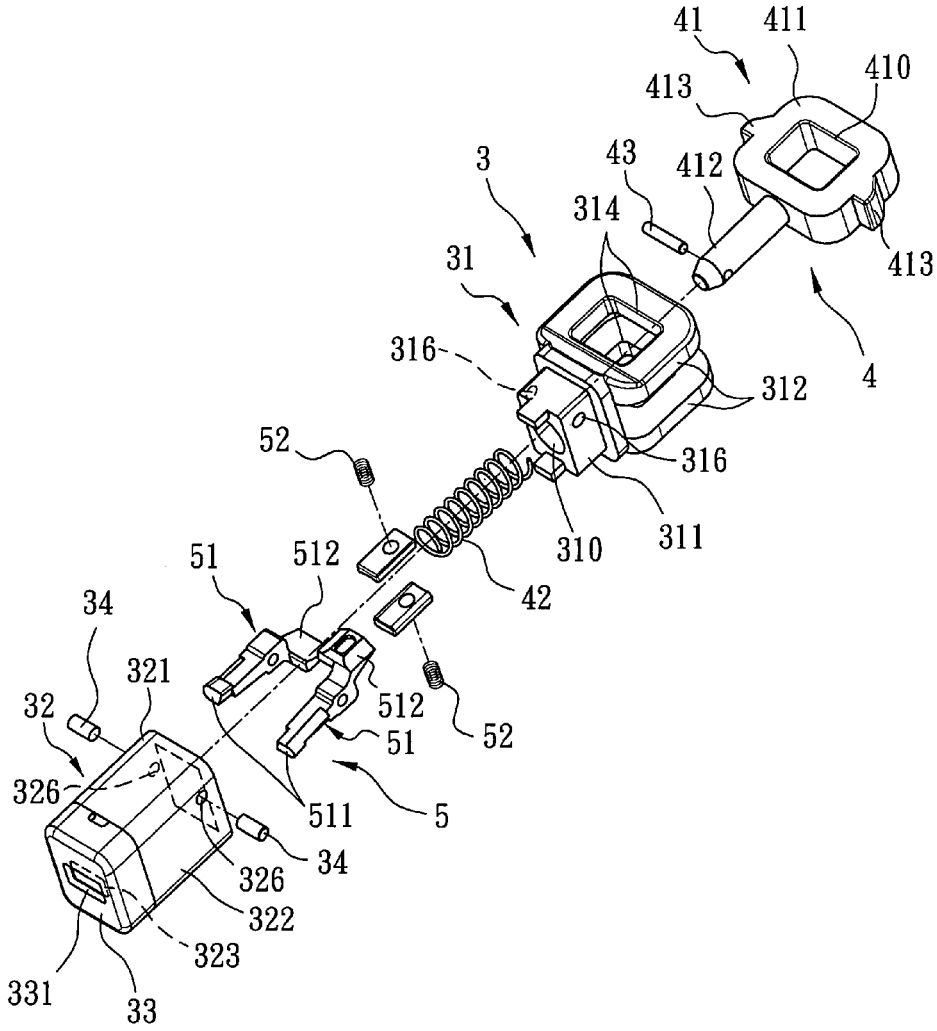
FIG. 2 is an exploded perspective view of one of the lock devices of the first preferred embodiment.
Figure 3:
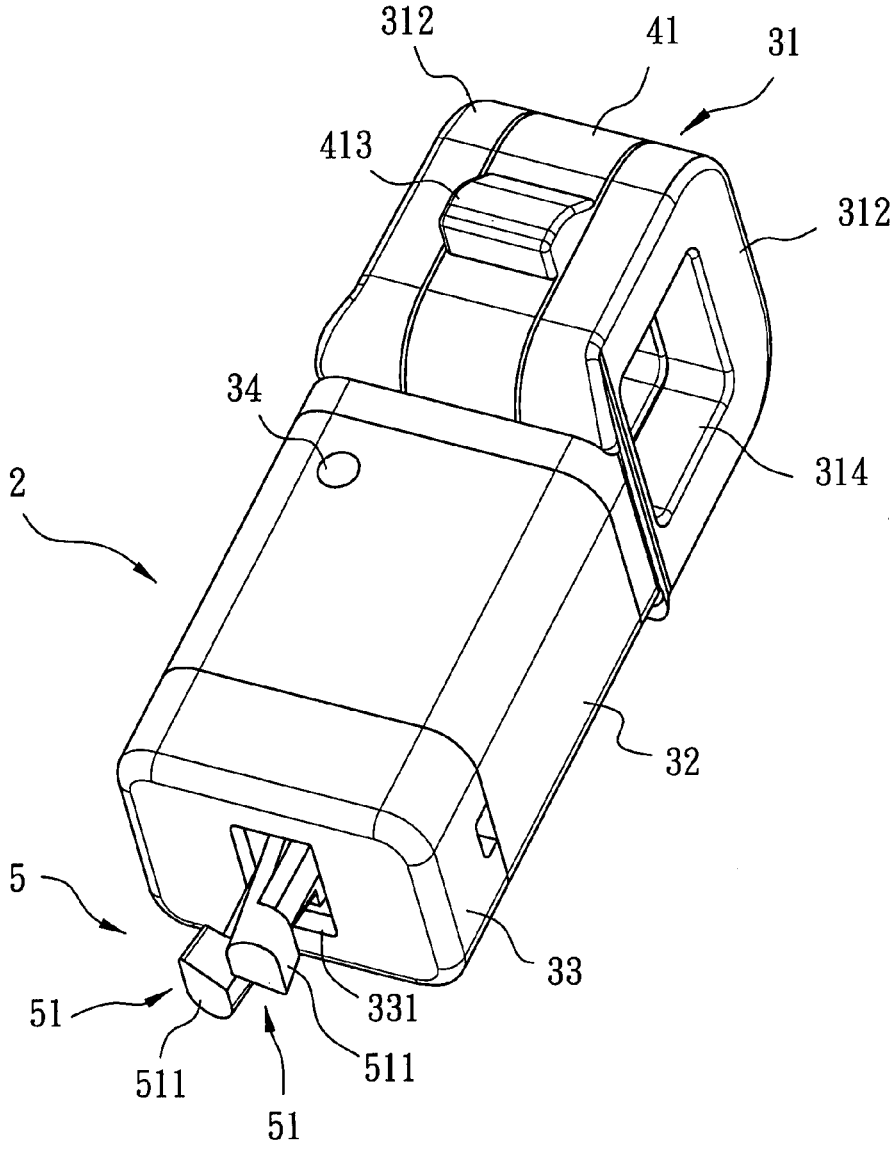
FIG. 3 is an assembled perspective view of one of the lock devices of the first preferred embodiment.
Figure 4:
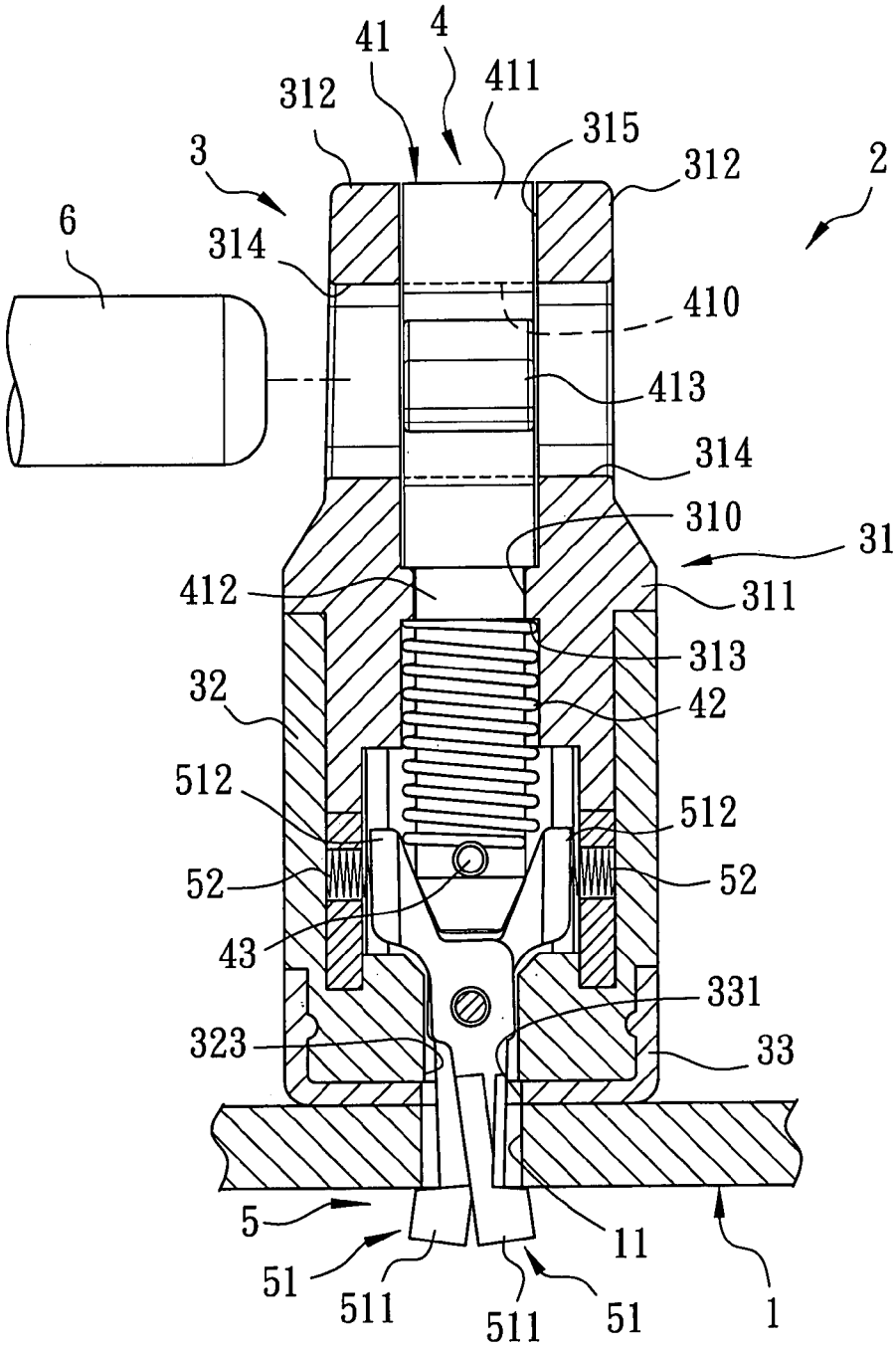
FIG. 4 is a fragmentary sectional view of one of the lock devices of the first preferred embodiment, illustrating a jaw actuator thereof at a locking position.
Figure 5:
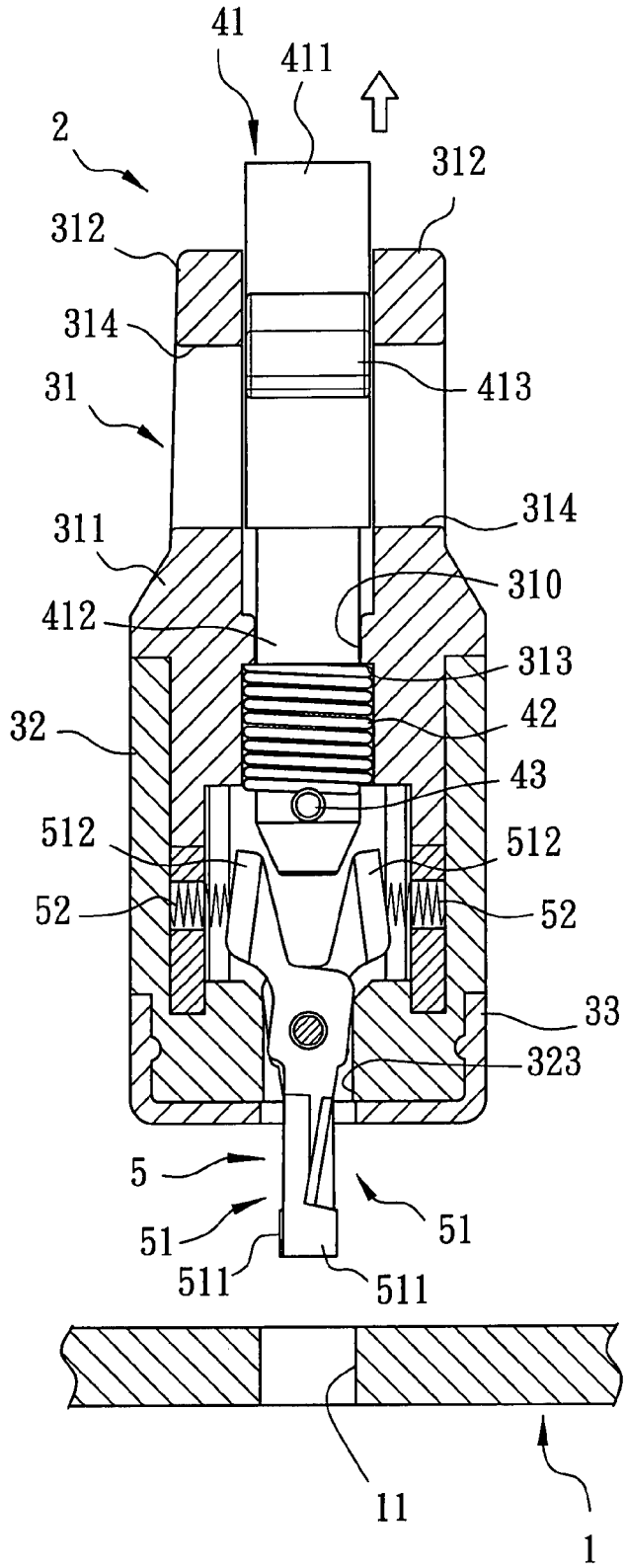
FIG. 5 is a sectional view of one of the lock devices of the first preferred embodiment, illustrating the jaw actuator at an unlocking position.

As shown in FIG. 2 and FIG. 3, the lock housing unit 3 includes an upper lock housing 31, a lower lock housing 32, and a sleeve member 33. The upper lock housing 31 has a coupling part 311 that is formed with a rod hole 310, and two positioning rings 312 that extend outwardly from the coupling part 311, that are spaced apart from and registered with each other, and that are each formed with a first ring hole 314. With further reference to FIG. 4 and FIG. 5, the coupling part 311 of the upper lock housing 31 is formed with a shoulder 313 that projects in radial inward directions in the rod hole 310. The first ring holes 314 of the positioning rings 312 cooperate to confine a gap 315 therebetween.

The lower lock housing 32 has a first end part 321 that is coupled to the coupling part 311 of the upper lock housing 31, and a second end part 322 that is opposite to the first end part 321 and that is formed with a jaw hole 323. In this embodiment, the lower lock housing 32 is a tube-shaped housing having a rectangular cross section.

The coupling part 311 of the upper lock housing 31 is further formed with two first pin holes 316, while the first end part 321 of the lower lock housing 32 is formed with two second pin holes 326 that are registered with the first pin holes 316. The lock housing unit 3 of each of the lock devices 2 further includes two pins 34 each received in the first and second pin holes 316, 326 so as to couple the first end part 321 of the lower lock housing 32 to the coupling part 311 of the upper lock housing 31.

The sleeve member 33 is coupled removably to the second end part 322 of the lower lock housing 32, and is formed with an opening 331 that is in spatial communication with the jaw hole 323.

As shown in FIG. 2 and FIG. 4, the jaw actuating unit 4 includes a jaw actuator 41 and an urging member 42. The jaw actuator 41 is operable to move relative to the lock housing unit 3 between locking and unlocking positions (see FIG. 4 and FIG. 5), and has a ring portion 411 that is disposed in the gap 315 confined between the positioning rings 312 of the upper lock housing 31, and an operating rod 412 that extends from the ring portion 411 and through the rod hole 310 in the upper lock housing 31. The ring portion 411 is formed with a second ring hole 410 that is aligned with the first ring holes 314 of the positioning rings 312 when the jaw actuator 41 is disposed at the locking position, as best shown in FIG. 4. The jaw actuating unit 4 further includes a supporting pin 43 that extends radially through the operating rod 412 adjacent to the distal end part of the same. The jaw actuator 41 further has two operating protrusions 413 that project outwardly and respectively from opposite sides of the ring portion 411 and that are accessible externally of the upper lock housing 31. The urging member 42 urges the jaw actuator 41 to the locking position, is sleeved on the operating rod 412, and has opposite ends that abut against the shoulder 313 and the supporting pin 43, respectively.

In this embodiment, the operating rod 412 has a frusto-conical distal end part, and the urging member 42 is a compression spring. The operating protrusions 413 facilitate pulling of the jaw actuator 41 by a user so as to move from the locking position to the unlocking position.

The jaw unit 5 includes an overlapping pair of locking jaws 51 received in the lower lock housing 32, and a pair of biasing members 52. The locking jaws 51 are pivoted to each other and to the lower lock housing 32. Each of the locking jaws 51 has a hooking section 511 that extends out of the jaw hole 323 in the lower lock housing 32 and that is extendible into the lock hole 11 of a corresponding object 1 to engage a periphery of the lock hole 11, and a force bearing section 512 that is opposite to the hooking section 511. The biasing members 52 bias the force bearing sections 512 of the locking jaws 51 toward each other. In this embodiment, each of the biasing members 52 is a compression spring that has one end abutting against the lower lock housing 32 and an opposite end abutting against the force bearing section 512 of a respective one of the locking jaws 51.

The locking chain 6 has a cross-section slightly smaller than the first ring holes 314 in the positioning rings 312 of the upper lock housing 31 and the second ring hole 410 in the ring portion 411 of the jaw actuator 41.

As shown in FIG. 4, the jaw actuator 41 is normally disposed at the locking position. The ring portion 411 of the jaw actuator 41 is aligned with the positioning rings 312 of the upper lock housing 31, and the distal end part of the operating rod 412 extends between and forces apart the force bearing sections 512 of the locking jaws 51 against the biasing action of the biasing members 52 when the jaw actuator 41 is biased by the urging member 42 to the locking position, thereby forcing the hooking sections 511 of the locking jaws 51 apart from each other such that the hooking sections 511 of the locking jaws 51 are capable of engaging the periphery of the lock hole 11 of the corresponding object 1 when extended into the lock hole 11. The locking chain 6 extends removably through the first ring holes 314 and the second ring hole 410 of each of the lock devices 2 whose jaw actuator 41 is disposed at the locking position, thereby arresting movement of the jaw actuators 41 of the lock devices 2 from the locking position (as shown in FIG. 4) to the unlocking position (as shown in FIG. 5) and thereby stringing together the lock devices 2.

As shown in FIG. 5, while the locking chain 6 is removed from the first ring holes 314 and the second ring hole 410 of the lock device 2, the positioning rings 312 of the upper lock housing 31 and the ring portion 411 of the jaw actuator 41 are misaligned, and the operating rod 412 of the jaw actuator 41 permits movement of the force bearing sections 512 of the locking jaws 51 of the jaw unit 5 toward each other by virtue of biasing action of the biasing members 52 when the jaw actuator 41 is pulled to the unlocking position, thereby forcing the hooking sections 511 of the locking jaws 51 toward each other such that the hooking sections 511 of the locking jaws 51 can be extended into and removed from the lock hole 11 and are unable to engage the periphery of the lock hole 11.

Therefore, to use one of the lock devices 2 of the lock assembly, it is first ensured that the locking chain 6 is removed from the first ring holes 314 and the second ring hole 410 of the lock device 2. Subsequently, the jaw actuator 41 of the jaw actuating unit 4 is pulled, by pulling the operating protrusions 413, to move from the locking position (as shown in FIG. 4) to the unlocking position (as shown in FIG. 5) so as to permit extension of the hooking sections 511 of the locking jaws 51 of the jaw unit 5 into the lock hole 11 in the corresponding object 1. The jaw actuator 41 is then released and is automatically restored to the locking position by virtue of urging force of the urging member 42. At this time, the hooking sections 511 of the locking jaws 51 engage the periphery of the lock hole 11, thereby mounting the lock device 2 on the corresponding object 1.

Referring back to FIG. 1, to use the lock assembly to protect a number of the objects 1 from theft, each of the lock devices 2 is locked to a corresponding one of the objects 1 by extending the hooking sections 511 of the locking jaws 51 into the lock hole 11 in the corresponding object 1 while pulling the jaw actuator 41 of the jaw actuating unit 4, followed by releasing the jaw actuator 41 so as to engage the hooking sections 511 of the locking jaws 51 to the periphery of the lock hole 11. Lastly, the locking chain 6 is passed through the first and second ring holes 314, 410 in the upper lock housing 31 and the jaw actuator 41 of each of the lock devices 2 on the objects 1, and is tied to a fixture 8, such as a post, at one end, such that the lock devices 2 are strung together.

It is noted herein that the cross-section of the locking chain 6 is designed to be slightly smaller than the first and second ring holes 314, 410 so that, after the locking chain 6 has been extended through the first and second ring holes 314, 410, there is insufficient room for the jaw actuator 41 to move from the locking position (as shown in FIG. 4) to the unlocking position (as shown in FIG. 5). As a result, the objects 1 are locked together to protect the same from theft.

Further, as shown in FIG. 4, in this embodiment, the sleeve member 33 of the lock housing unit 3 of each of the lock devices 2 abuts against an outer surface of the corresponding one of the objects 1 when the lock device 2 is locked onto the object 1, such that wobbling of the lock device 2 is prevented. It is noted herein that the sleeve member 33 can be formed with bumps at one surface thereof for abutting against the surface of the object 1 in other embodiments of the present invention. However, since thickness of the part of the object 1 formed with the lock hole 11 may differ from object to object, the sleeve member 33 of the present invention is designed to have varying sizes and to be removably coupled to the second end part 322 of the lower lock housing 32 such that a suitably sized sleeve member 33 can be used according to the object 1 to be locked so as to ensure that wobbling is prevented.

In sum, the lock assembly of the present invention can be used to lock a number of objects 1 using a single locking chain 6. In addition, it is no longer necessary to include separate keys in the lock assembly for locking or unlocking of the lock devices 2. Therefore, not only is the number of locking chain 6 reduced to one, but handling of the keys is also eliminated. Consequently, the lock assembly of the present invention is more convenient to use and to manage, and cost thereof is reduced as compared to the prior art. In addition, a tidy environment can be maintained.

Figure 6:
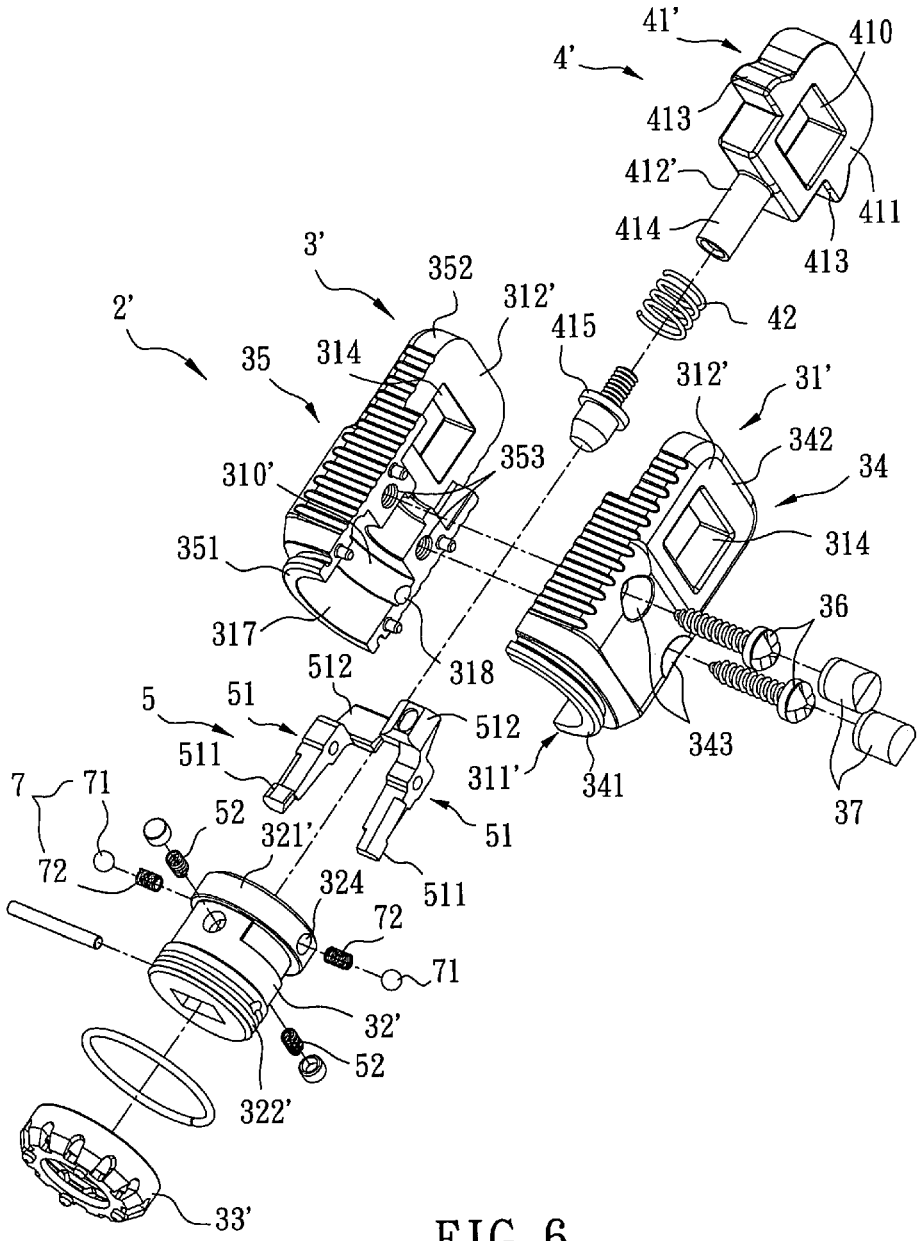
FIG. 6 is an exploded perspective view of one of a plurality of lock devices included in the second preferred embodiment of a lock assembly according to the present invention.
Figure 7:
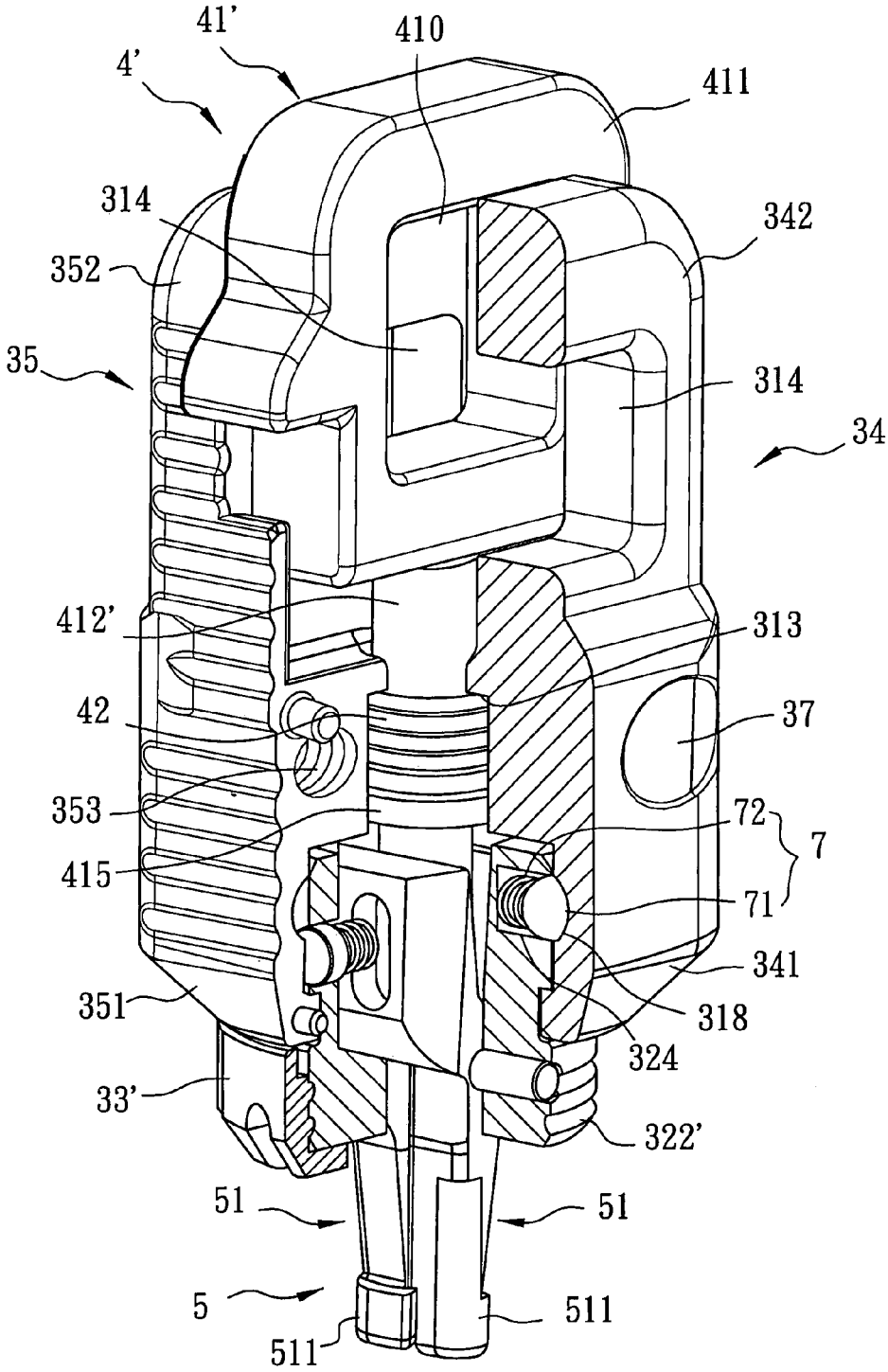
FIG. 7 is an assembled partly-sectional view of one of the lock devices of the second preferred embodiment.

As shown in FIG. 6 and FIG. 7, the second preferred embodiment of a lock assembly according to the present invention differs from the first preferred embodiment in that the upper lock housing 31' and the jaw actuator 41' of each of the lock devices 2' according to the second preferred embodiment are rotatable relative to the jaw unit 5 such that the first and second ring holes 314, 410 can be rotated to cope with the position of the locking chain 6 (as shown in FIG. 1) so that the locking chain 6 does not need to be bent when applied to the lock device 2', thereby making insertion of the locking chain 6 smooth. Moreover, each of the lock devices 2' of the second preferred embodiment further includes a positioning unit 7.

In this embodiment, the upper lock housing 31' of the lock housing unit 3' of each of the lock devices 2' includes first and second housing bodies 34, 35 coupled to each other. Each of the first and second housing bodies 34, 35 has a lower end part 341, 351, and an upper end part 342, 352 that extends from the lower end part 341, 351. The lower end parts 341, 351 of the first and second housing bodies 34, 35 cooperate to serve as the coupling part 311' of the upper lock housing 31', and define the rod hole 310' and a rotation space 317 therebetween and in spatial communication with each other. The upper end parts 342, 352 of the first and second housing bodies 34, 35 are formed with the positioning rings 312', respectively. The first end part 321' of the lower lock housing 32' is received in the rotation space 317 and is coupled rotatably to the lower end parts 341, 351 of the first and second housing bodies 34, 35.

The lock housing unit 3' of each of the lock devices 2' further includes two fasteners 36. One of the first and second housing bodies 34, 35 of the upper lock housing 31' is formed with two through holes, while the other one of the first and second housing bodies 34, 35 of the upper lock housing 31' is formed with two fastening holes registered with the through holes, respectively. In this embodiment, the first housing body 34 is formed with the through holes 343, and the second housing body 35 is formed with the fastening holes 353. Each of the fasteners 36 extends through a corresponding one of the through holes 343 and engages a corresponding one of the fastening holes 353 for coupling the first and second housing bodies 34, 35 to each other. In this embodiment, the fasteners 36 are screw fasteners.

In this embodiment, the lock housing unit 3' of each of the lock devices 2' further includes two plugs 37 received respectively and removably in the through holes 343 for concealing the fasteners 36, respectively.

In this embodiment, a sleeve member 33' is also included in the lock housing unit 3' to couple removably to the second end part 322' of the lower lock housing 32'. By using sleeve members 33' with varying sizes such that the sleeve member 33' of each of the lock devices 2' abuts against the outer surface of the corresponding one of the objects 1 (as shown in FIG. 1) when the lock device 2' is locked onto the object 1, the lock devices 2' of the second preferred embodiment are also prevented from wobbling relative to the objects 1.

In the second preferred embodiment, the first end part 321' of the lower lock housing 32' is formed with two receiving slots 324 (only one is visible in FIG. 6 and FIG. 7). The lower end parts 341, 351 of the first and second housing bodies 34, 35 of the upper lock housing 31' are formed with two positioning grooves 318 (only one is visible in FIG. 6 and FIG. 7). The positioning unit 7 includes two ball bearings 71, and two springs 72 each received in a corresponding one of the receiving slots 324 for biasing a corresponding one of the ball bearings 71 toward the lower end parts 341, 351 of the first and second housing bodies 34, 35. The first end part 321' of the lower lock housing 32' is received securely in the rotation space 317 when the ball bearings 71 are respectively received in the positioning grooves 318.

Figure 8:
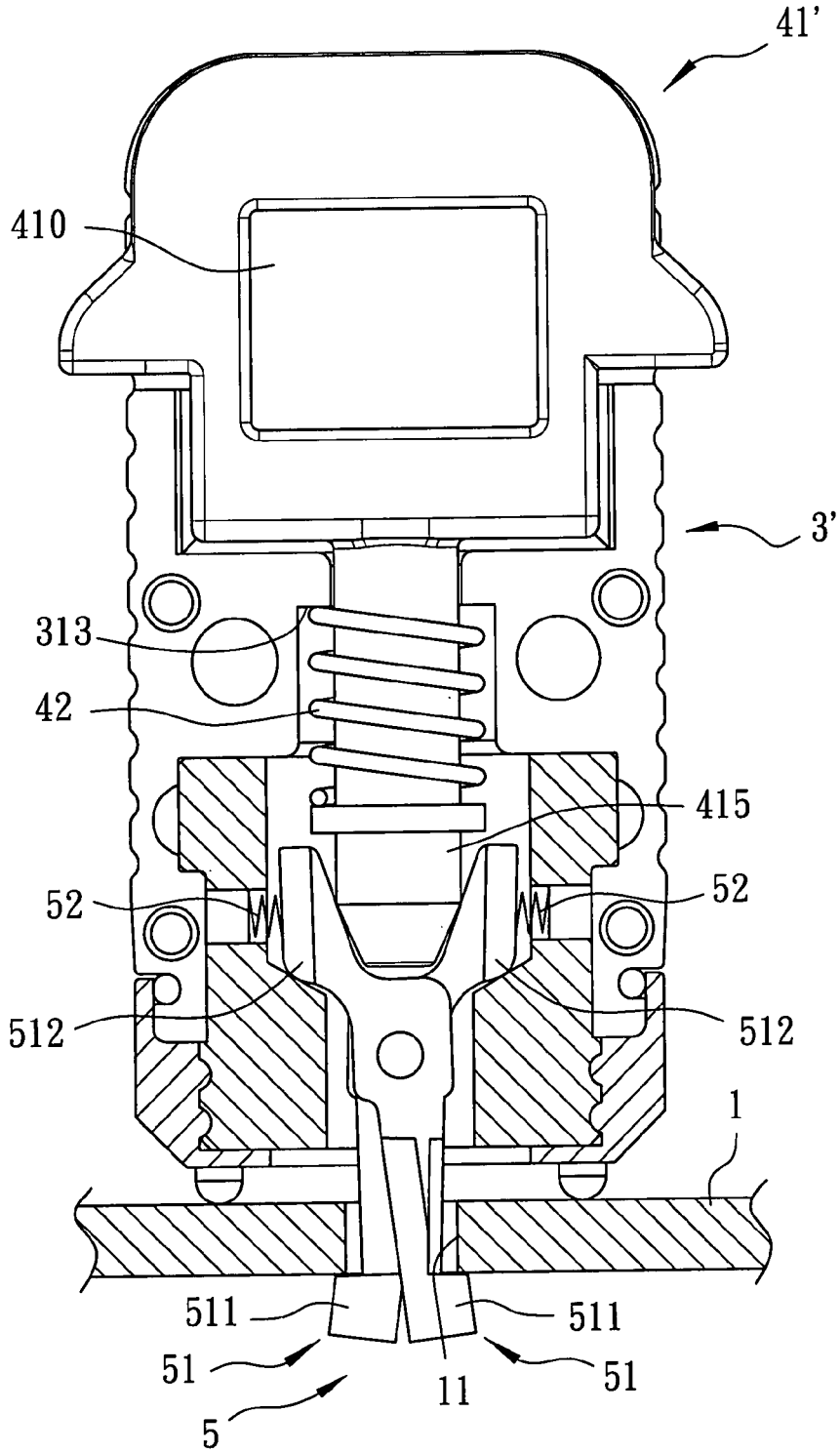
FIG. 8 is a sectional view of one of the lock devices of the second preferred embodiment, illustrating a jaw actuator thereof at a locking position.

The coupling part 311' of the upper lock housing 31' is formed with the shoulder 313 that projects in radial inward directions in the rod hole 310'. The operating rod 412' of the jaw actuator 41' of the jaw actuating unit 4' includes a rod body 414 that extends from the ring portion 411, and a supporting member 415 that is coupled to the rod body 414 opposite to the ring portion 411. The urging member 42 of the jaw actuating unit 4' is sleeved on the rod body 414 and has opposite ends that abut against the shoulder 313 and the supporting member 415, respectively. The supporting member 415 forces apart the force bearing sections 512 of the locking jaws 51 when the jaw actuator 41' is disposed at the locking position (as shown in FIG. 8). In this embodiment, one end of the supporting member 415 is frustoconical in shape, and the other end of the supporting member 415 is coupled threadedly to the rod body 414.

Figure 9:
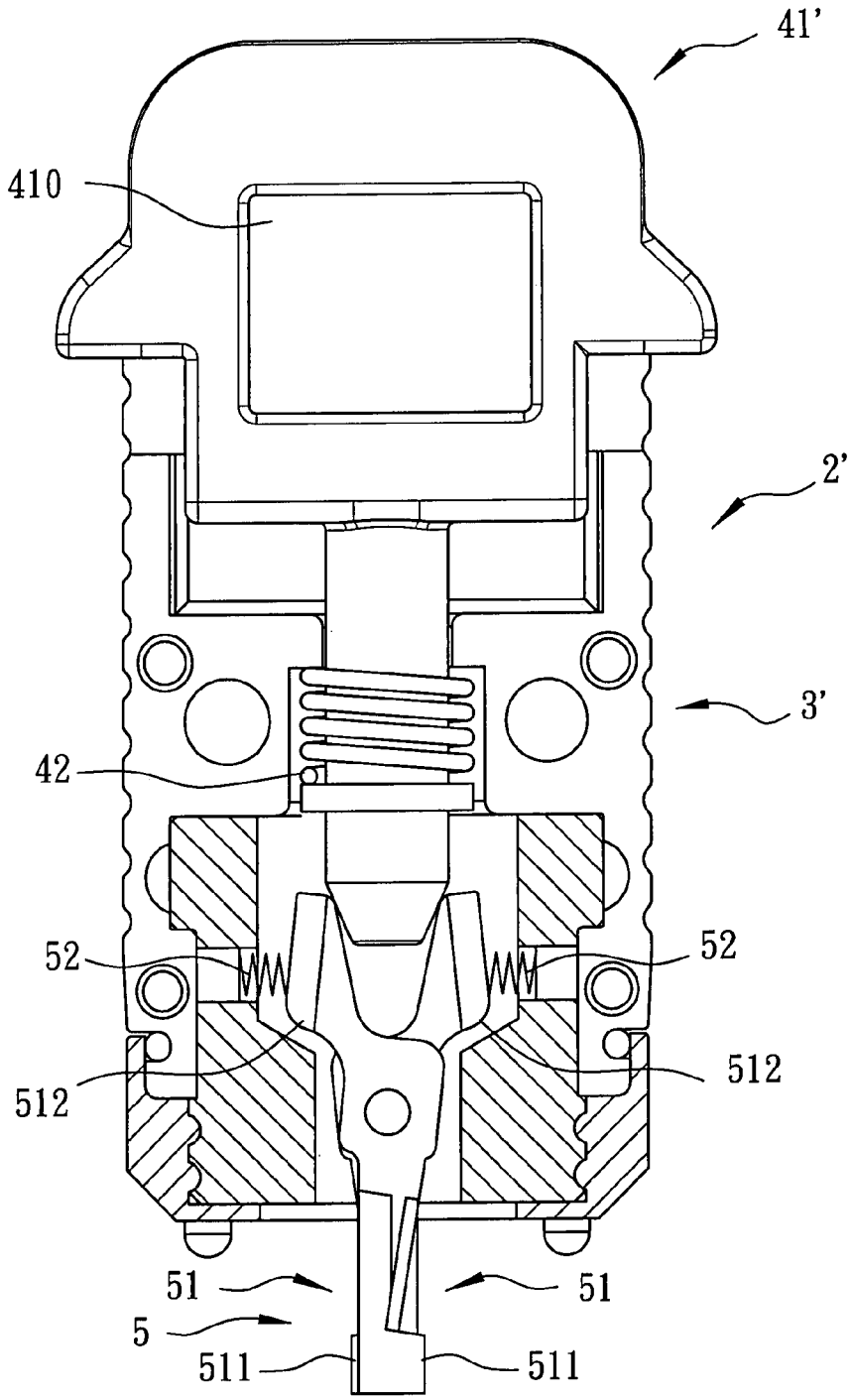
FIG. 9 is a sectional view of one of the lock devices of the second preferred embodiment, illustrating the jaw actuator at an unlocking position.

FIG. 8 and FIG. 9 respectively illustrate one of the lock devices 2' of the second preferred embodiment disposed at the locking and unlocking positions. Since operating principles of the second preferred embodiment are identical to those of the first preferred embodiment, further details of the same are omitted herein for the sake of brevity.

Figure 10:
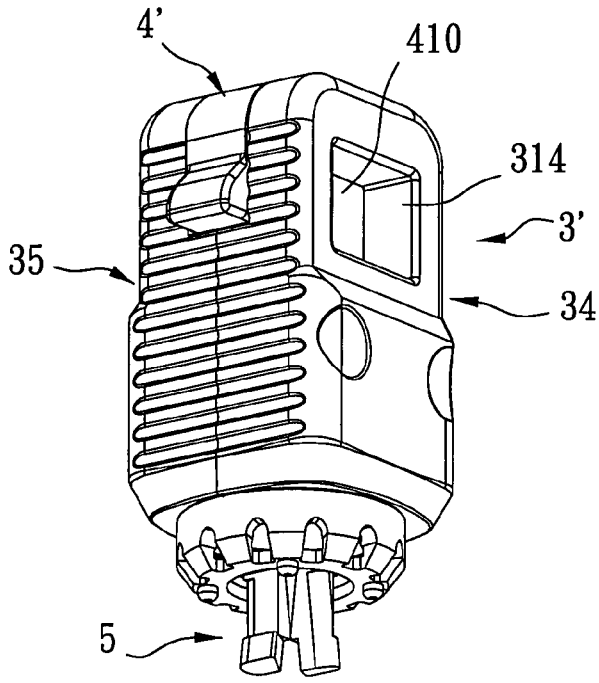
FIG. 10 and FIG. 11 are perspective views of one of the lock devices of the second preferred embodiment, illustrating rotation of a lock housing thereof.
Figure 11:
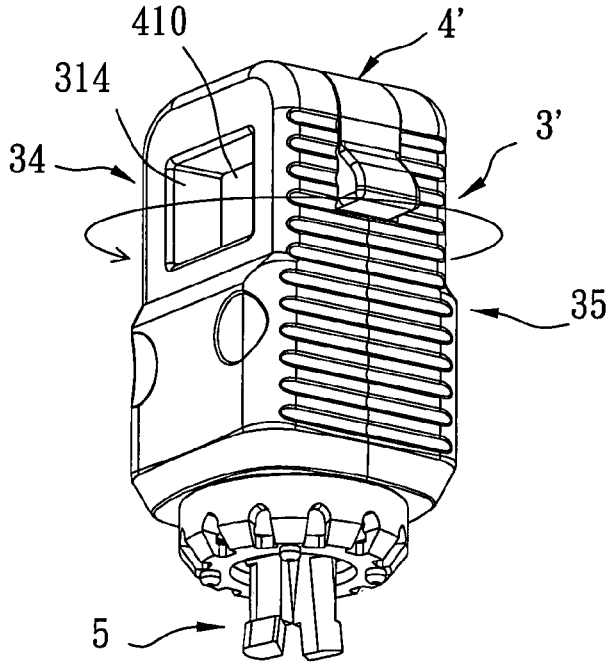

As shown in FIG. 7, FIG. 10 and FIG. 11, when the lower end parts 341, 351 of the first and second housing bodies 34, 35 of the upper lock housing 31' are rotated relative to the first end part 321' of the lower lock housing 32' such that the receiving slots 324 formed in the first end part 321' are respectively registered with the positioning grooves 318 formed in the lower end parts 341, 351, the ball bearings 71 are respectively biased by the springs 72 toward the lower end parts 341, 351 so as to be received in the positioning grooves 318, thereby locking the lower lock housing 32' in place relative to the upper lock housing 31'. When an external force is exerted on the upper lock housing 31' to overcome the biasing force of the springs 72, the ball bearings 71 are respectively received in the receiving slots 324, and the upper lock housing 31' can once again be rotated relative to the lower lock housing 32'.

Referring to FIG. 1, FIG. 10 and FIG. 11, since the lock holes 11 in the objects 1 may not be oriented in the same direction, and since placement arrangements of the objects 1 may be restricted by the environment, each of the lock devices 2' of the lock assembly according to the second preferred embodiment permits rotation of the upper lock housing 31' relative to the lower lock housing 32', which in turn permits rotation of the jaw actuator 41' along with the upper lock housing 31' relative to the jaw unit 5' coupled to the lower lock housing 32'. Consequently, the user can, without changing the orientation of the objects 1 to vary opening direction of the lock holes 11 thereof, rotate the upper lock housing 31' and the jaw actuator 41' such that the first and second ring holes 314, 410 permit smooth insertion of the locking chain 6 therethrough and avoid twisting and bending of the locking chain 6, thereby enhancing convenience of the lock assembly during use.

In sum, the lock assembly of the present invention utilizes the displacement of the jaw actuator 41 (41') relative to the lock housing unit 3 (3') and the urging force of the urging member 42 to move each of the lock devices 2 (2') between the locking and unlocking positions, shown respectively in FIG. 4 (FIG. 8) and FIG. 5 (FIG. 9), without having to use any keys. In addition, a single locking chain 6 is used for stringing together all of the lock devices 2 (2') so as to lock the objects 1 collectively. Therefore, handling of the keys is eliminated so that the lock assembly of the present invention is convenient to use and to manage. Further, by reducing the number of locking chain 6 in use to one, expenses incurred in purchasing of the same is reduced, and a tidy environment is maintained. Moreover, by designing a rotatable lock housing unit 3', the locking chain 6 can be applied more easily to the lock devices 2', thereby enhancing the convenience of the lock assembly of the present invention during use.

While the present invention has been described in connection with what are considered the most practical and preferred embodiments, it is understood that the present invention is not limited to the disclosed embodiments but is intended to cover various arrangements included within the spirit and scope of the broadest interpretation so as to encompass all such modifications and equivalent arrangements.

What is claimed is:

1. A lock assembly adapted for use with at least one object having a lock hole, said lock assembly comprising:

a plurality of lock devices, each of which includes a lock housing unit including an upper lock housing having a coupling part that is formed with a rod hole, and two positioning rings that extend outwardly from said coupling part, that are spaced apart from and registered with each other, and that are each formed with a first ring hole, and a lower lock housing having a first end part coupled to said coupling part of said upper lock housing, and a second end part formed with a jaw hole;

a jaw actuating unit including a jaw actuator operable to move relative to said lock housing unit between locking and unlocking positions, said jaw actuator having a ring portion that is confined between said positioning rings of said upper lock housing, and that is formed with a second ring hole, and an operating rod that extends from said ring portion and through said rod hole in said upper lock housing, and an urging member for urging said jaw actuator to the locking position; and a jaw unit including an overlapping pair of locking jaws received in said lower lock housing, said locking jaws being pivoted to each other and to said lower lock housing, each of said locking jaws having a hooking section that extends out of said jaw hole in said lower lock housing and that is extendible into the lock hole in one of the objects to engage a periphery of the lock hole, and a force bearing section opposite to said hooking section, and a pair of biasing members for biasing said force bearing sections of said locking jaws toward each other;

wherein said ring portion is aligned with said positioning rings and said operating rod extends between and forces apart said force bearing sections of said locking jaws when said jaw actuator is at the locking position, thereby forcing said hooking sections of said locking jaws apart from each other such that said hooking sections of said locking jaws are capable of engaging the periphery of the lock hole when extended into the lock hole; and wherein said positioning rings and said ring portion are misaligned, and said operating rod permits movement of said force bearing sections of said locking jaws toward each other by virtue of biasing action of said biasing members when said jaw actuator is at the unlocking position, thereby forcing said hooking sections of said locking jaws toward each other such that said hooking sections of said locking jaws can be extended into and removed from the lock hole and are unable to engage the periphery of the lock hole; and a locking chain having a cross-section slightly smaller than said first and second ring holes, and extended removably through said first ring holes and said second ring hole of each of said lock devices, thereby arresting movement of said jaw actuators of said lock devices from the locking position to the unlocking position and thereby stringing together said lock devices.

2. The lock assembly as claimed in claim 1, wherein said lock housing unit of each of said lock devices further includes a sleeve member coupled removably to said second end part of said lower lock housing, and formed with an opening that is in spatial communication with said jaw hole.

3. The lock assembly as claimed in claim 1, wherein said coupling part of said upper lock housing of each of said lock devices is formed with a shoulder that projects in radial inward directions in said rod hole, said jaw actuating unit of each of said lock devices further including a supporting pin that extends radially through said operating rod, said urging member of said jaw actuating unit being sleeved on said operating rod and having opposite ends that abut against said shoulder and said supporting pin, respectively.

4. The lock assembly as claimed in claim 1, wherein said jaw actuator of each of said lock devices further has two operating protrusions that project outwardly from said ring portion and that are accessible externally of said upper lock housing.

5. The lock assembly as claimed in claim 1, wherein said operating rod of said jaw actuator of each of said lock devices has a frustoconical distal end part.

6. The lock assembly as claimed in claim 1, wherein said coupling part of said upper lock housing of each of said lock devices is formed with a first pin hole, said first end part of said lower lock housing being formed with a second pin hole that is registered with said first pin hole, said lock housing unit of each of said lock devices further including a pin received in said first pin hole and said second pin hole so as to couple said first end part of said lower lock housing to said coupling part of said upper lock housing.

7. The lock assembly as claimed in claim 2, wherein said coupling part of said upper lock housing of each of said lock devices is formed with a shoulder that projects in radial inward directions in said rod hole, said jaw actuating unit of each of said lock devices further including a supporting pin that extends radially through said operating rod, said urging member of said jaw actuating unit being sleeved on said operating rod and having opposite ends that abut against said shoulder and said supporting pin, respectively.

8. The lock assembly as claimed in claim 2, wherein said jaw actuator of each of said lock devices further has two operating protrusions that project outwardly from said ring portion and that are accessible externally of said upper lock housing.

9. The lock assembly as claimed in claim 2, wherein said operating rod of said jaw actuator of each of said lock devices has a frustoconical distal end part.

10. The lock assembly as claimed in claim 2, wherein said coupling part of said upper lock housing of each of said lock devices is formed with a first pin hole, said first end part of said lower lock housing being formed with a second pin hole that is registered with said first pin hole, said lock housing unit of each of said lock devices further including a pin received in said first pin hole and said second pin hole so as to couple said first end part of said lower lock housing to said coupling part of said upper lock housing.

11. A lock assembly adapted for use with at least one object having a lock hole, said lock assembly comprising:

a plurality of lock devices, each of which includes a lock housing unit including an upper lock housing having a coupling part that is formed with a rod hole, and two positioning rings that extend outwardly from said coupling part, that are spaced apart from and registered with each other, and that are each formed with a first ring hole, said upper lock housing including first and second housing bodies coupled to each other, each of said first and second housing bodies having a lower end part and an upper end part that extends from said lower end part, said lower end parts of said first and second housing bodies cooperating to serve as said coupling part of said upper lock housing, and defining said rod hole and a rotation space therebetween and in spatial communication with each other, said upper end parts of said first and second housing bodies being formed with said positioning rings, respectively, and a lower lock housing having a first end part coupled to said coupling part of said upper lock housing, and a second end part formed with a jaw hole, said first end part of said lower lock housing being received in said rotation space and being coupled rotatably to said lower end parts of said first and second housing bodies;

a jaw actuating unit including a jaw actuator operable to move relative to said lock housing unit between locking and unlocking positions, said jaw actuator having a ring portion that is confined between said positioning rings of said upper lock housing, and that is formed with a second ring hole, and an operating rod that extends from said ring portion and through said rod hole in said upper lock housing, and an urging member for urging said jaw actuator to the locking position; and a jaw unit including an overlapping pair of locking jaws received in said lower lock housing, said locking jaws being pivoted to each other and to said lower lock housing, each of said locking jaws having a hooking section that extends out of said jaw hole in said lower lock housing and that is extendible into the lock hole in one of the objects to engage a periphery of the lock hole, and a force bearing section opposite to said hooking section, and a pair of biasing members for biasing said force bearing sections of said locking jaws toward each other;

wherein said ring portion is aligned with said positioning rings and said operating rod extends between and forces apart said force bearing sections of said locking jaws when said jaw actuator is at the locking position, thereby forcing said hooking sections of said locking jaws apart from each other such that said hooking sections of said locking jaws are capable of engaging the periphery of the lock hole when extended into the lock hole; and wherein said positioning rings and said ring portion are misaligned, and said operating rod permits movement of said force bearing sections of said locking jaws toward each other by virtue of biasing action of said biasing members when said jaw actuator is at the unlocking position, thereby forcing said hooking sections of said locking jaws toward each other such that said hooking sections of said locking jaws can be extended into and removed from the lock hole and are unable to engage the periphery of the lock hole; and a locking chain having a cross-section slightly smaller than said first and second ring holes, and extended removably through said first ring holes and said second ring hole of each of said lock devices, thereby arresting movement of said jaw actuators of said lock devices from the locking position to the unlocking position and thereby stringing together said lock devices.

12. The lock assembly as claimed in claim 11, wherein said lock housing unit of each of said lock devices further includes a sleeve member coupled removably to said second end part of said lower lock housing, and formed with an opening that is in spatial communication with said jaw hole.

13. The lock assembly as claimed in claim 11, wherein said coupling part of said upper lock housing of each of said lock devices is formed with a shoulder that projects in radial inward directions in said rod hole, said operating rod of said jaw actuating unit of each of said lock devices including a rod body that extends from said ring portion, and a supporting member that is coupled to said rod body opposite to said ring portion, said urging member of said jaw actuating unit of each of said lock devices being sleeved on said rod body and having opposite ends that abut against said shoulder and said supporting member, respectively;

said supporting member forcing apart said force bearing sections of said locking jaws when said jaw actuator is at the locking position.

14. The lock assembly as claimed in claim 11, wherein said jaw actuator of each of said lock devices further has two operating protrusions that project outwardly from said ring portion and that are accessible externally of said upper lock housing.

15. The lock assembly as claimed in claim 11, wherein each of said lock devices further includes a positioning unit, said first end part of said lower lock housing of each of said lock devices being formed with a receiving slot, said lower end parts being formed with a positioning groove, said positioning unit including a ball bearing and a spring received in said receiving slot for biasing said ball bearing toward said lower end parts of said first and second housing bodies, said first end part of said lower lock housing being received securely in said rotation space when said ball bearing is received in said positioning groove.

16. The lock assembly as claimed in claim 11, wherein said lock housing unit of each of said lock devices further includes a fastener, one of said first and second housing bodies of said upper lock housing of each of said lock devices being formed with a through hole, the other one of said first and second housing bodies of said upper lock housing of each of said lock devices being formed with a fastening hole registered with said through hole, said fastener extending through said through hole and engaging said fastening hole for coupling said first and second housing bodies to each other.

17. The lock assembly as claimed in claim 16, wherein said lock housing unit of each of said lock devices further includes a plug received removably in said through hole to conceal said fastener.

18. The lock assembly as claimed in claim 13, wherein each of said lock devices further includes a positioning unit, said first end part of said lower lock housing of each of said lock devices being formed with a receiving slot, said lower end parts being formed with a positioning groove, said positioning unit including a ball bearing and a spring received in said receiving slot for biasing said ball bearing toward said lower end parts of said first and second housing bodies, said first end part of said lower lock housing being received securely in said rotation space when said ball bearing is received in said positioning groove.

19. The lock assembly as claimed in claim 13, wherein said lock housing unit of each of said lock devices further includes a fastener, one of said first and second housing bodies of said upper lock housing of each of said lock devices being formed with a through hole, the other one of said first and second housing bodies of said upper lock housing of each of said lock devices being formed with a fastening hole registered with said through hole, said fastener extending through said through hole and engaging said fastening hole for coupling said first and second housing bodies to each other.

20. The lock assembly as claimed in claim 19, wherein said lock housing unit of each of said lock devices further includes a plug received removably in said through hole to conceal said fastener.

21. The lock assembly as claimed in claim 13, wherein said jaw actuator of each of said lock devices further has two operating protrusions that project outwardly from said ring portion and that are accessible externally of said upper lock housing.

* * * * *